United States Patent [19]

Spadaro

[11] 4,445,230

[45] Apr. 24, 1984

[54] BAG WITH INTEGRAL CLOSURE TIE

[76] Inventor: Giorgio I. Spadaro, 221 Princeton Dr., Albuquerque, N. Mex. 87106

[21] Appl. No.: 389,214

[22] Filed: Jun. 17, 1982

[51] Int. Cl.[3] ..... B65D 33/06

[52] U.S. Cl. ..... 383/7; 383/26; 383/76; 383/77; 383/37

[58] Field of Search ..... 229/54, 62, 63; 150/11; 206/390; 383/7, 26, 62, 76, 77, 92

[56] References Cited

U.S. PATENT DOCUMENTS

| | | | |
|---|---|---|---|
| 3,716,182 | 2/1973 | Korn | 229/62 |
| 3,752,388 | 8/1973 | Lynch | 229/63 |
| 3,865,303 | 2/1975 | Korn | 229/62 |
| 3,961,743 | 6/1976 | Hollowell | 229/62 |
| 4,345,712 | 8/1982 | Gim | 229/62 |

*Primary Examiner*—Stephen P. Garbe
*Attorney, Agent, or Firm*—Norman Lettvin

[57] ABSTRACT

A bag construction with integral tie means is provided cut from an elongated flattened tube of bag material, such as a thin walled plastic sheath. The flattened tube of material is cut with a lazy-U cut that extends across the entire width thereof to provide a pair of diametrically located elongated ties at, and extending from, adjacent the open end of the bag body, while the other end of the bag is sealed to provide a closed bag end. The bag body is pierced, or cut, to provide pairs of slits through the walls of the bag through which the free ends of the ties may be threaded, to gather together the open end of the bag to effect a closure of the bag, and to be tied together to retain the contents of the bag therein.

3 Claims, 3 Drawing Figures

BAG WITH INTEGRAL CLOSURE TIE

FIELD OF THE INVENTION

This invention relates to a bag with an integral closure tie therefor, and more particularly to such a bag for use as an all purpose plastic bag.

BACKGROUND OF THE INVENTION

It is known to provide bags specifically formed from a tube of plastic, and for use as a garbage bag. Such garbage bags are cut and heat sealed adjacent one end thereof from an endless tube of plastic. In order to close such a bag that has been partially filled, the plastic sleeve adjacent the open end thereof is to be gathered into a closing neck, and then either tied into a knot, or is kept gathered by a separate tie member supplied by the user or by the vendor of the bags. The separate tie members that are commonly known commercially are anything that will hold the gathered neck closed, and such ties include a paper coated flexible wire, that permits such twisting of the wire as desired to effect a tie, or a strip of plastic that is punched, or preformed, to provide an interlock between sections of the strip after one end of the strip, with a lug thereon, has been inserted through an aperture on another portion of the strip that is formed with a cooperating lug retainer therein. The provision, and use, of tie members that are separate from the bag represents an additional cost factor that, desirably, may be eliminated.

Thus, it is one object of this invention to provide an improved bag, such as a garbage bag, with an integral tie means provided thereon.

Another object of this invention is to provide a bag with integral tie means thereon that is formed from an endless tube of plastic, with no wastage of plastic material by reason of forming the bag integral with its tie means, thereby providing a highly cost-effective product.

Further objects and advantages will be evident to one skilled in the art from the following description of my invention.

SUMMARY OF THE INVENTION

A bag is formed from a tube of bag material, such as a plastic tube, with tie closure means provided integral with the bag. The bag is to be cut from the tube by die means, to provide a pair of elongated tie members at opposite edges of the bag adjacent the bag mouth. The tie members are arranged to cooperate with slits in the bag wall adjacent the bag mouth, to insure good closure of the bag and to provide means for carrying the filled bag thereby. When the bag with integral tie means is formed from a tube of plastic, the cutting of the tube material to the desired shape; the sealing of one end of the tube; and the slitting of the tube adjacent its open end may be easily performed by means known in the art.

DETAILED DESCRIPTION OF THE INVENTION

Figure 1:
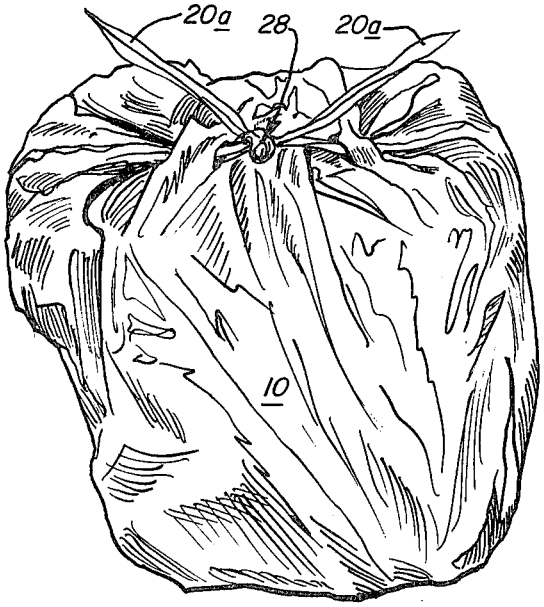
FIG. 1 is a perspective view of a filled combination bag and tie means therefor, embodying the features of my invention.
Figure 2:
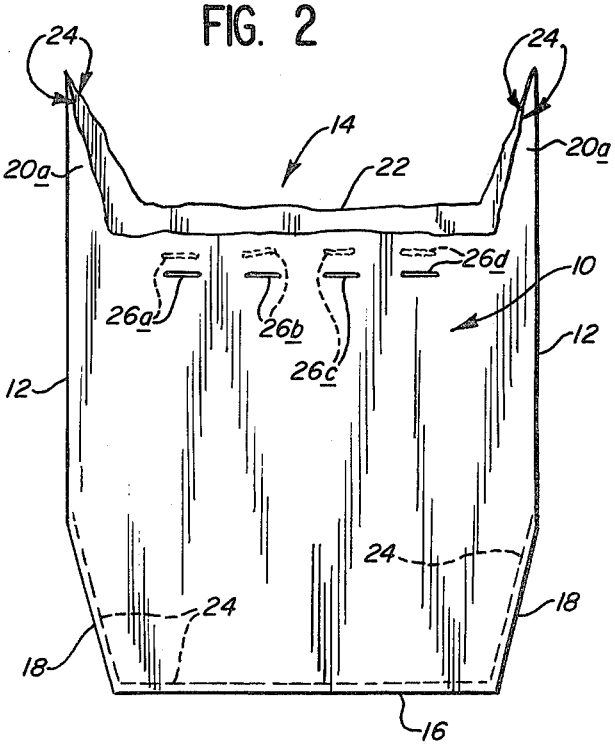
FIG. 2 is a plan view of the bag in its condition after being cut from a tube of plastic.
Figure 3:
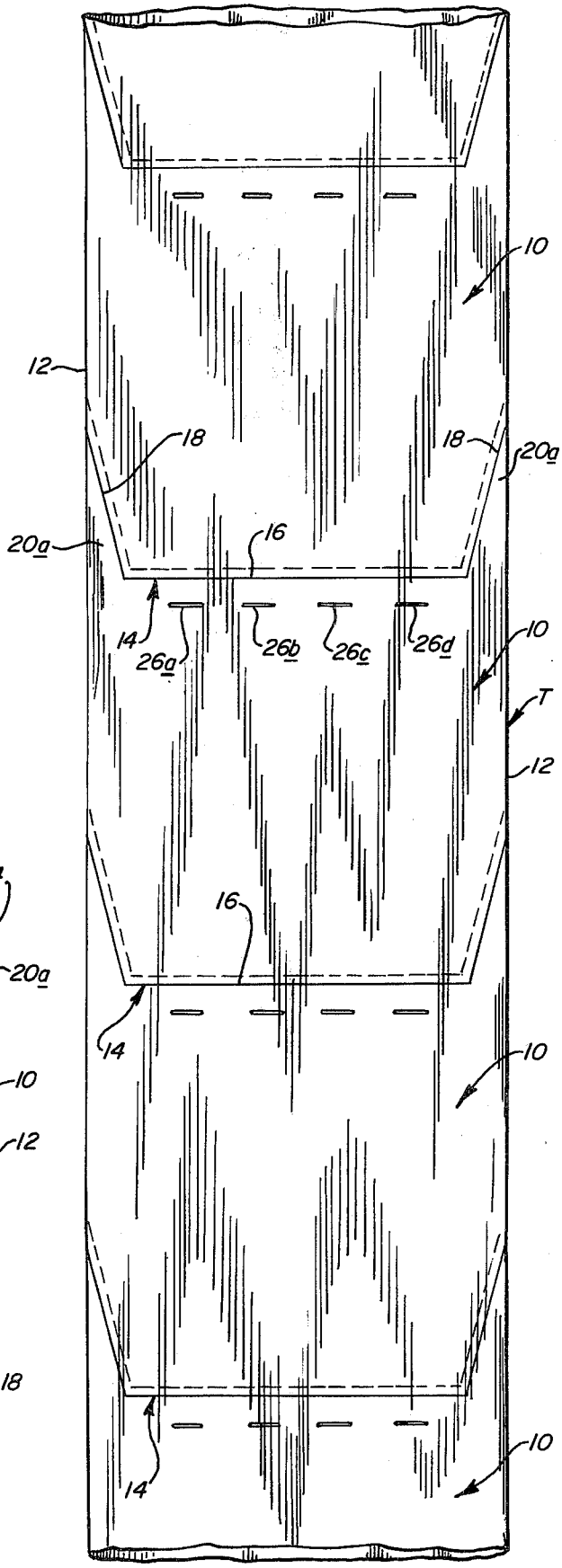
FIG. 3 is an illustrative plan view of a tube of plastic from which the bag of FIG. 2 is formed by cutting, or severing, and showing how wastage of plastic tube material, in the forming of the bag of FIGS. 1 and 2, is avoided.

Referring now to the drawing, the Figures illustrate the improved bag with integral tie elements for closing the open end of the bag.

Referring, first, to prior art, it is, of course, known to provide bags, such as formed from a thin walled plastic sheath, or tube, by severing a segment from an elongated, or endless, tube T of such material by a straight line cut through the entire width of the tube transversely of its length, and then sealing one of the ends of the severed segment thereby providing a tube segment that is closed at one end to provide the bag's bottom, and open at the opposite end to provide the bag's mouth. A typical, well known, product of this type is a garbage bag, such as sold under the trademark "GLAD".

In the instant invention, instead of providing, as in prior art, a straight line cut transverse of the length of the collapsed and flat tube of material across the entire width of the tube, to sever a bag-forming segment 10 from a tube of material T with longitudinal diametrical edges 12, in the improved construction disclosed herein, a lazy U-shaped cut 14 is made across the width of tube T wherein the bottom, or bight, 16 of the U is straight and stops short of both of the edges 12, but then continues along two upright, and outwardly inclined, legs 18 of the U cut, to and through the diametric edges 12 of flattened tube T.

This lazy U-shaped cut 14 serves to define two inverted, dart-like gussets **20*a* that have been cut from the one longitudinal end of the tube segment 10, leaving said gussets 20*a* as part of the opposite end of the following tube segment 10, which will next be cut from the following portion of endless tube T. Since the leading end of tube T has already been cut, by a preceeding operation, the opposite open end 14 of the tube segment 10 is shown with two diametrically located, inverted, dart-like, tie-gusset segments 20*a*** extending therefrom.

The reason that the gussets **20*a* are said to be inverted and dart-like, is because in women's fashions the concept of a "dart" is well known as a shape of substantially an isosceles triangle of small included apex angle whose apex terminates at, or is anchored in, a transverse body such as a waist band. Here, the tie gussets 20*a* are in the shape of an isosceles triangle, but the small apex angle is free from connection to a transverse member, while the base opposite the included apex angle is integral with and thereby anchored to the material of the tube segment 10 at a region adjacent the free edge 22 of open end 14 of the bag-forming segment 10. This free edge 22 is complementary to the straight cut 16, since it is made by the severing along line 16**.

The total included angle 24 at the apex of the inverted dart, or gusset, is about 30°. This included angle could be increased or decreased, within a reasonable range of modification, say ±5°-10°, to perform the intended function.

At about the time of severance of the tube segment 10 from tube T, and preferably substantially simultaneously with such severance along the lazy-U cut 14, a portion of the bag-forming segment 10 that is adjacent cut 14 is sealed along a line 24. When the tube T is of plastic material, the sealing is preferably by heat sealing, or sonic welding, as is known in the art, thereby providing a closed bottom for bag-forming segment 10. The seal line 24 parallels the segments of cut 14, and may be spaced therefrom, as shown. In the preferred construction, the material of tube T is plastic of type well known for use is garbage bag construction, although the same principles disclosed herein may be used in providing bags from tubes of other materials.

Also, substantially simultaneously with effecting the lazy-U cut 14, a trailing section of tube T, which is spaced from the open, or free, edge 22 of the next bag segment 10, is pierced at a plurality of locations to provide a plurality of pairs of aligned slits 26 through opposite sides of the flattened plastic tube T. The number of slits 26 may be selected as required. As preferably shown, four slits pairs 26*a*, 26*b*, 26*c* and 26*d* are created, to provide lace holes for the tie gussets 20. A single tool, or die, not shown, may be used to effect the lazy-U cut 14, the sealing 24, and the cutting, or piercing, of slits pairs 26, either by use of a punch plate tool, or by a roller tool, that rotates in synchronism with longitudinal movement of the tube T past the station where cutting, sealing and piercing is to be effected.

The inverted darts, or tie gussets, 20 are selected to be of an axial length such that the tapered free ends of each tie gusset 20 may be threaded through two pairs of slits, or lace holes, 26 provided adjacent the open end 14. Thus, after the bag is filled to a desired capacity, but leaving sufficient material adjacent the open end 14 to be gathered together to close the bag, the left hand dart, or gusset, 20*a* is to be threaded through the two adjacent pairs of slits 26*a* and 26*b* on opposite sides of the open end 14, and the right hand dart or gusset, 20*a* is threaded through the two pairs of slits 26*d* and 26*c*, thereby serving as means to gather together the bag material at the open end of the bag, and the free ends of the two darts 20*a* may then be tied together in a knot 28 to keep the bag closed.

In the bag shown herein, the effective height of the bag material, between free edge 22 and straight cut portion 16 is about 30 inches, the width of the tube between spaced edges 12 is about 33 inches, and the length of the dart 20*a*, measured from a projection of free edge 22 to the apex or tip of tie 20*a* is about 12 inches. The length of each of slits 26 is about two inches. The included apex angle of the dart 26*a* when laid flat, is about 30 degrees, so that, in effect, each cut 18 intersects an edge 12 of tube T at an included angle of about 15 degrees.

While I have disclosed herein a bag with one form of an integral closure tie, persons skilled in that art will appreciate that the invention herein may be adapted and modified for related purposes, and it is intended to cover all aspects of my invention herein, as limited solely by the claims appended hereto.

What is claimed and desired to be secured by Letters Patent of the United States is:

1. A bag formed from an elongated tube of plastic film having a lateral and longitudinal extent and which has been flattened diametrically to provide only two, laterally spaced, diametrically opposed, longitudinal edges; said bag including two side walls, a bottom end, and an open top end;

said bottom end including (1) a lower edge defined by a lazy - U-shaped line of severance which extends diametrically across the entire lateral extent of the tube, and (2) a continuous, lazy -U-shaped heat-sealed seam which closes the bottom end of the bag and is congruent with, and spaced closely adjacent to, said line of severance, said side walls, which have the same shape and size, lying against each other across the entire length and width of said bag and being bounded by said open top end, said longitudinal edges, and said line of severance, said open top end of the bag being in the shape of a lazy -U which is congruent with the lowermost edge, thereby forming a pair of inverted tie gusset extensions, each of said extensions being bisected by one of said longitudinal edges such that, when the tie gusset extension is flattened and spread, it is in the shape of an isosceles triangle whose apex lies on its corresponding longitudinal edge, said bag further including, adjacent its open top end, a plurality of perforations formed in and through both bag walls, with the perforations in each wall being laterally spaced from each other across the width of the bag, and with all said perforations being adapted to have at least one of the two tie gusset extensions threaded therethrough, to provide means integral with the bag for gathering together the open mouth of the bag, and the length of said tie gussets permitting the extended ends thereof to be tied together to provide only a single handle that functions for both closing the open mouth of the bag and for carrying the closed bag thereby.

2. A construction as in claim 1 wherein the plurality of perforations in each wall includes laterally spaced perforations arranged in a line transverse to said spaced, diametrically opposed, longitudinal lateral edges of the tube of plastic.

3. A construction as in claim 1 wherein the included angle at the apex of the tie gusset is about 30 degrees.

* * * * *